United States Patent [19]

Zbikowski et al.

[11] 4,121,555

[45] Oct. 24, 1978

[54] TRANSMISSION LINKAGE

[75] Inventors: Gerhard Zbikowski, Friedrichshafen; Salahaddin Geafer, Markdorf, both of Germany

[73] Assignee: Motoren-und Turbinen-Union Friedrichshafen GmbH, Germany

[21] Appl. No.: 695,557

[22] Filed: Jun. 14, 1976

[30] Foreign Application Priority Data

Jun. 14, 1975 [DE] Fed. Rep. of Germany ..... 2526662

[51] Int. Cl.[2] ..... F02D 1/04

[52] U.S. Cl. ..... 123/140 R

[58] Field of Search ..... 123/140, 108, 97 R, 123/98

[56] References Cited

U.S. PATENT DOCUMENTS

| | | | |
|---|---|---|---|
| 3,577,968 | 5/1971 | Staudt et al. | 123/140 R |
| 3,620,199 | 11/1971 | Kuhn et al. | 123/140 R |

*Primary Examiner*—Samuel W. Engle
*Assistant Examiner*—Thomas H. Webb
*Attorney, Agent, or Firm*—Craig & Antonelli

[57] ABSTRACT

A transmission linkage construction arranged between a governor and a fuel metering device of an internal combustion engine with the linkage construction selectively positioning a control rod of the fuel metering device in response to predetermined speeds of the internal combustion engine sensed by the governor. The control rod is positionable at a plurality of positions defined between a maximum fuel filling position and a zero fuel filling position. The transmission linkage construction includes a pivotally mounted transmission lever operatively connected with the governor and the control rod of the fuel metering device by way of connecting linkages with the connecting linkage between the control rod and transmission lever being effected by way of an arm fixedly secured to the transmission lever at an adjustable distance from the pivot point of the transmission lever. In the zero fuel filling position, the arm forms an approximately right angle with the connecting linkage extending between the control rod and the transmission lever.

17 Claims, 3 Drawing Figures

TRANSMISSION LINKAGE

The present invention relates to a linkage construction and, more particularly, to a transmission linkage arrangement disposed between a centrifugal governor and a fuel metering device of an internal combustion engine, which arrangement includes a transmission lever pivotable about a fixed fulcrum with a collar of the centrifugal governor and a control rod of the fuel metering device being articulated to the transmission lever by way of at least one connecting link member.

The collar of a centrifugal governor normally has a constant path, while the path of a control rod of a fuel metering device, for example, a fuel injection pump, varies in dependence upon the particular operating or load condition of an internal combustion engine. To compensate for the differing paths of the governor collar and control rod, it has been proposed to provide a rotatably mounted transmission lever to which the governor collar is articulated at a fixed distance with the control rod being articulated at a variable distance from a fulcrum of a transmission lever. In accordance with this proposal, one end point of the governor collar path coincides with a "zero filling" position of the fuel metering device control rod and the other end point of the collar path coincides with a "maximum filling" position of such control rod.

One disadvantage of the above-noted proposed solution lies in the fact that, since the maximum filling position or position providing the maximum desirable fuel to the internal combustion engine and the corresponding position of the control rod of the fuel metering device vary in dependence upon the particular utilization of the internal combustion engine and/or the various types of internal combustion engines, the specific positioning of the transmission linkage must be re-determined in each individual case if the governor and fuel metering device are retained. However, with the adjustment of the "maximum filling" position, which can only be effected during the operation of the internal combustion engine, the adjustment of the "zero filling" position is likewise changed so that considerable experimentation is required to re-determine the correct "zero filling" position of the governor collar path with respect to the control rod path.

A further transmission linkage has been proposed wherein the transmission lever thereof is fashioned to include a circular arcuate portion, the center of which represents a fulcrum between the fuel metering device control rod and the connecting linkage in the "zero filling" position of the control rod. While this proposed construction permits a change of the lever arm and thus an increase and/or reduction of the control rod path with the same governor collar path without losing the preset "zero filling" position, a disadvantage lies in the fact that difficulties are encountered in the construction and manufacture of the circular arc-shaped transmission lever because an articulation must be set and fixed in position at the circular arc without any play. Furthermore, in this proposed construction, the fuel metering device and the governor are accommodated in separate housings so that the exact maintenance of the center of the circular arc is not ensured during assembly due to the occurring tolerances and the resultant differing positions of the transmission lever.

The aim underlying the present invention essentially resides in providing an improved transmission linkage between a centrifugal governor and a fuel metering device, whereby an accurate setting of the "maximum filling" position of the fuel metering device can be accomplished in a simple manner on an operating internal combustion engine without changing the "zero filling" position of the metering device and without considering or taking into account normal manufacturing tolerances when effecting the necessary setting.

According to one feature of the present invention, a linkage is provided for connecting a control rod of the fuel metering device to the transmission lever with an arm forming a connecting joint between the linkage and transmission lever. The arm is adjustably mounted along the transmission lever so as to vary the distance between the pivot point or fulcrum of the transmission lever and the connection point of the linkage with means being provided for fixing the arm to the transmission lever at a selected distance.

According to a further feature of the present invention, the arm forming the connecting joint between the connecting linkage and the transmission lever is arranged such that the longitudinal axis of the arm subtends a right angle with a line extending between the connection points of the connecting linkage with the control rod and with such arm.

According to yet another feature of the present invention, means are provided for permitting a fine adjustment between the connecting point of the arm with the connecting linkage and the point of rotation of the transmission lever so as to permit a variation between these two points within predetermined limits.

Preferably, the connection between the arm and transmission lever is effected by way of a pin member accommodated in an elongated slot or hole provided in the transmission lever. The pin member includes an abutment or holding shoulder at which is arranged a clamping element for mounting the arm to the transmission lever so as to permit an adjustment between the pivot point of the transmission lever and the connection point of the arm with the control rod connecting linkage. An adjusting pin is receivable in a bore provided at the pin member so as to maintain, during assembly, a right angle between the arm and the control rod connecting linkage when the transmission linkage is set at a "zero filling" position.

In order to ensure the adjustability of the arm relative to the pivot point of the transmission lever, in accordance with yet another feature of the present invention, the arm includes a screw portion received in a threaded bore provided in the clamping element with a counter nut being provided to secure the arm in its adjusted position.

By virtue of the construction of the transmission linkage in accordance with the present invention, an exact, clearance free association of the control rod position for "maximum filling" with the corresponding position of the governor collar takes place only in the installed condition. Consequently, the dimensional deviations present have no effect on the exact maintenance of the "maximum filling" quantity. Furthermore, by the fine adjustment provision of the present invention, the assocation of the control rod position for "zero filling" with the corresponding position of the collar of the centrifugal governor is affected only to such a minor extent that this is not at all noticeable under practical conditions whereby the fine adjustment of the maximum filling on the engine in operation can be accomplished in a very simple manner.

Accordingly, it is an object of the present invention to provide a transmission linkage between a governor and fuel metering device which avoids, by simple means, the afore-mentioned shortcomings and drawbacks encountered in the prior art.

A further object of the present invention resides in providing a transmission linkage between a governor and fuel metering device which permits a variation of the adjustment of the "maximum filling" position with the existing "zero filling" position either not being changed, or changed within negligible limits.

A further object of the present invention resides in providing a transmission linkage between a centrifugal governor and fuel metering device which can readily be installed and removed without any difficulties.

Still another object of the present invention resides in providing a transmission linkage between a centrifugal governor and fuel metering device which can be manufactured inexpensively and without any difficulties.

These and other objects, features and advantages of the present invention will become more apparent from the following description when taken in connection with the accompanying drawings which show, for the purposes of illustration only, one embodiment of a transmission linkage in accordance with the present invention, and wherein.

Figure 1:
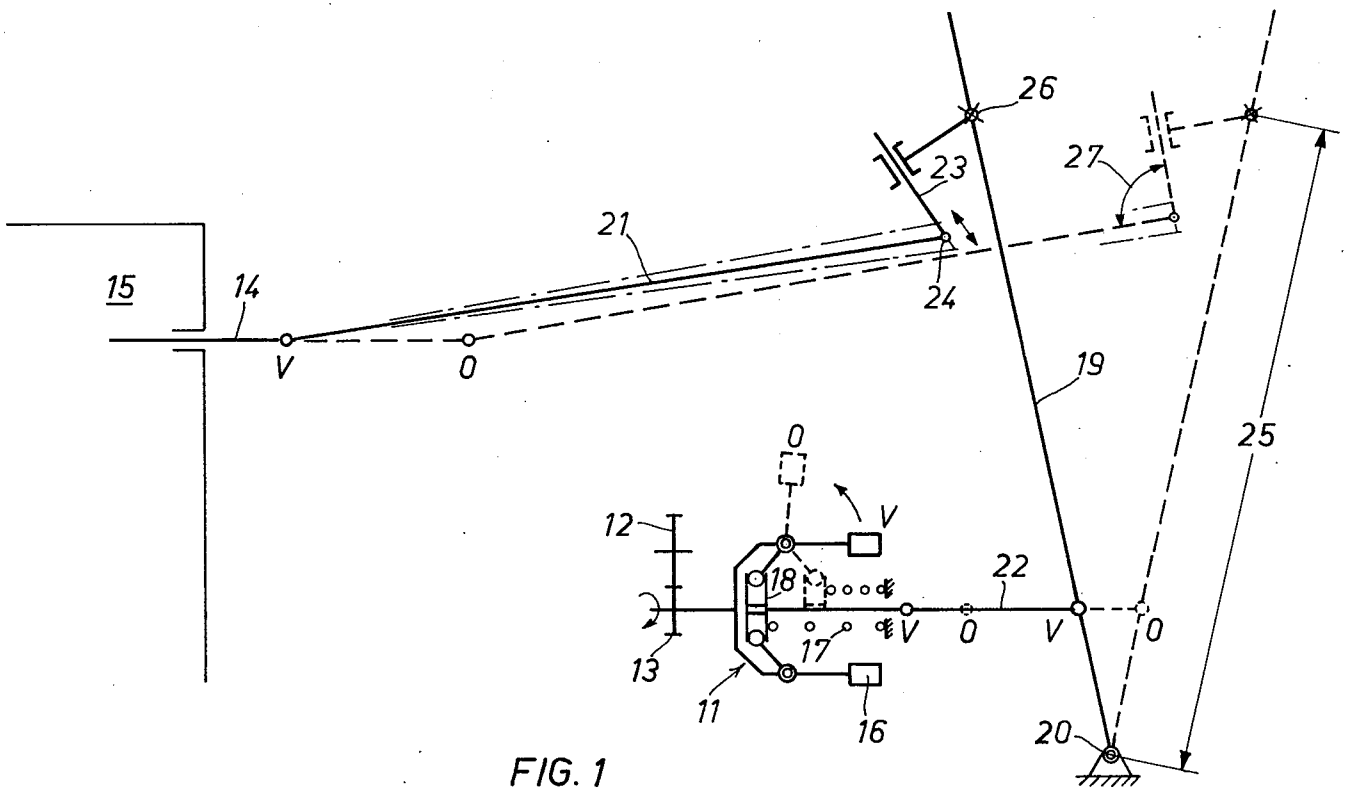
FIG. 1 is a schematic illustration of a transmission linkage between a centrifugal governor and an injection pump of an internal combustion engine in accordance with the present invention.

Referring now to the drawings, wherein like reference numerals are used throughout the various views to designate like parts and, more particularly, to FIG. 1, according to this figure, a centrifugal governor generally designated by the reference numeral 11 is arranged on a shaft coupled to an internal combustion engine, for example, a diesel engine (not shown), by way of a transmission arrangement such as gears 12, 13.

A control rod 14 of a fuel metering device, for example, a conventional fuel injection pump 15, is connected by way of a transmission linkage to the governor 11 whereby the control rod 14 is selectively positioned by the governor 11 at positions defined between a "maximum filling" position V and a "zero filling" position O.

The centrifugal governor 11 includes flyweights 16 and a governor spring 17 which normally biases a governor collar 18 toward the solid line position of FIG. 1. The spring force of the governor springs 17 and the flyweights 16 are selected and synchronized so that, upon rotation of the shaft connected to the internal combustion engine, the flyweights 16 will be displaced radially outwardly due to the centrifugal force acting thereon, thereby resulting in the collar 18 being displaced against the bias or force of the spring 17. Upon the shaft of the internal combustion engine reaching a required or predetermined maximum desired speed, the flyweights 16 are disposed at the position illustrated in the phantom line in FIG. 1, which position corresponds to the "zero filling" position O of the fuel metering device, at which position the fuel supply to the engine is interrupted.

To compensate for the differing paths of motion between the governor collar 18 and the path of the control rod 14 which is different in each application depending upon the specific type of engine and the operating or load characteristics of such engine, a transmission linkage is provided which includes a transmission lever 19 pivotally mounted about a fulcrum or fixed pivot point 20 with a connection linkage 21 being articulated to the transmission lever 19 at an adjustable distance 25 from the pivot point 20. A further connecting linkage 22 is arranged between the governor collar 18 and the transmission lever 19 whereby the displacement of the governor collar 18 from the "maximum filling" position V, shown in solid lines in FIG. 1, results in the connecting linkages 21, 22, transmission lever 19, and control rod 14, being displaced to the "zero filling" position O shown in phantom lines in FIG. 1. The phantom lines in FIG. 1 indicate only the position of the various elements while at the zero filling position O and are in no way intended to indicate the path of travel, which, of course, would be arcuate.

An arm 23 joins the connecting linkage 21 to the transmission lever 19 with the point of connection 26 being variable so as to permit a coarse or preliminary adjustment of the "maximum filling" position V by selecting a distance 25 between the connection point 26 and pivot point 20 which conforms to the specific characteristics of the internal combustion engine to which the transmission linkage is applied. Upon completion of the coarse or preliminary adjustment, the arm 23 is fixed with respect to the transmission lever 19 so that a longitudinal axis of the arm 23 subtends a right angle 27 with a line extending between the connection points of the linkage 21 with the control rod 14 and the arm 23 when the transmission linkage is in a "zero filling" position O.

The arm 23 is adjustably mounted with respect to the connection point 26 in the direction indicated by the double-headed arrow in FIG. 1, whereby the distance between the fulcrum or connecting point 24 and the pivot point 20 of the transmission lever 19 may be varied within predetermined limits. By virtue of this arrangement, the "maximum filling" position V can accurately be set by a fine adjustment to a desired value with no noticeable change in the "zero filling" position O of the transmission linkage.

Figure 2:
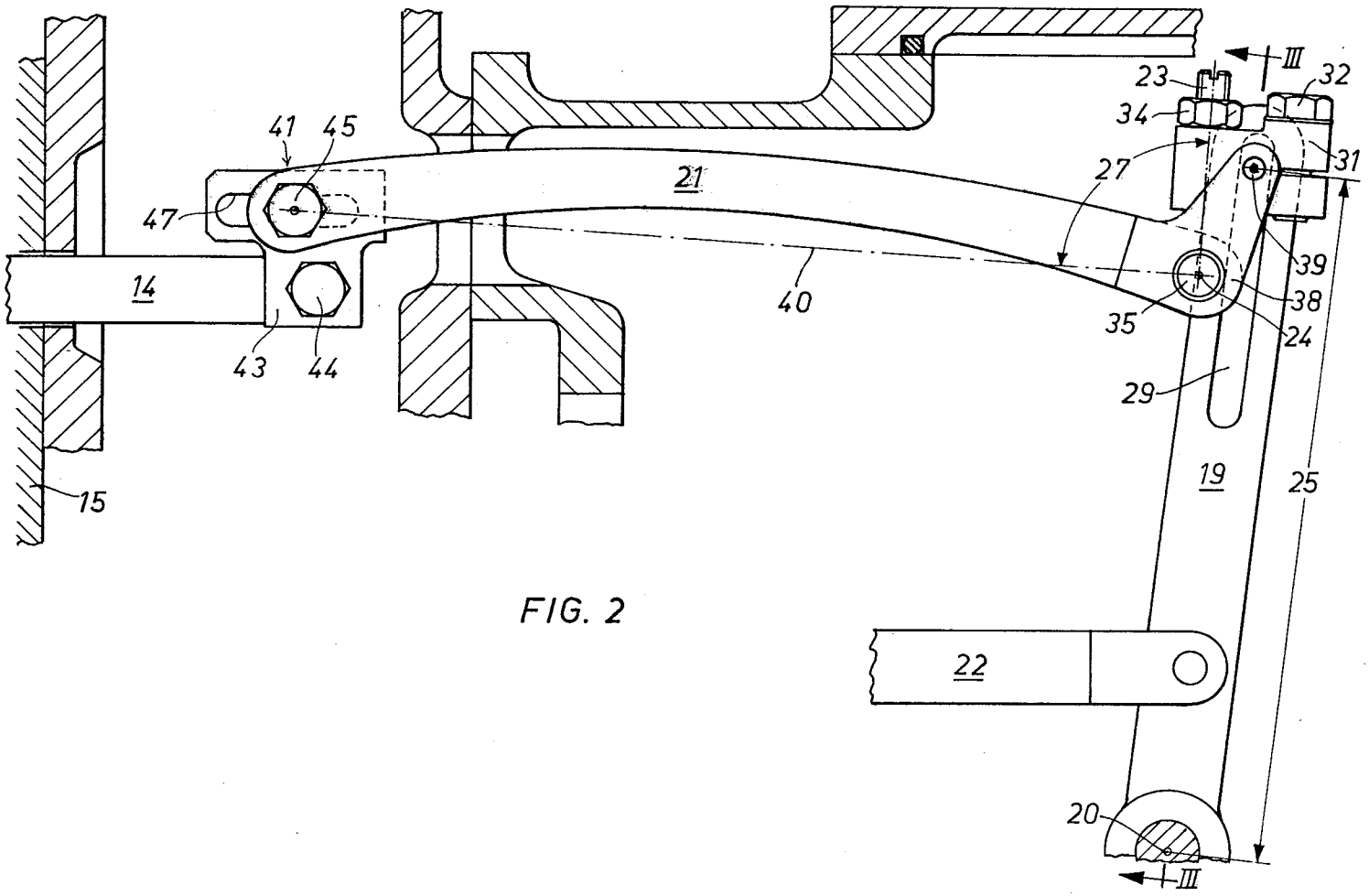
FIG. 2 is a partial cross-sectional view of the constructional details of a transmission linkage in accordance with the present invention in a "zero filling" position.
Figure 3:
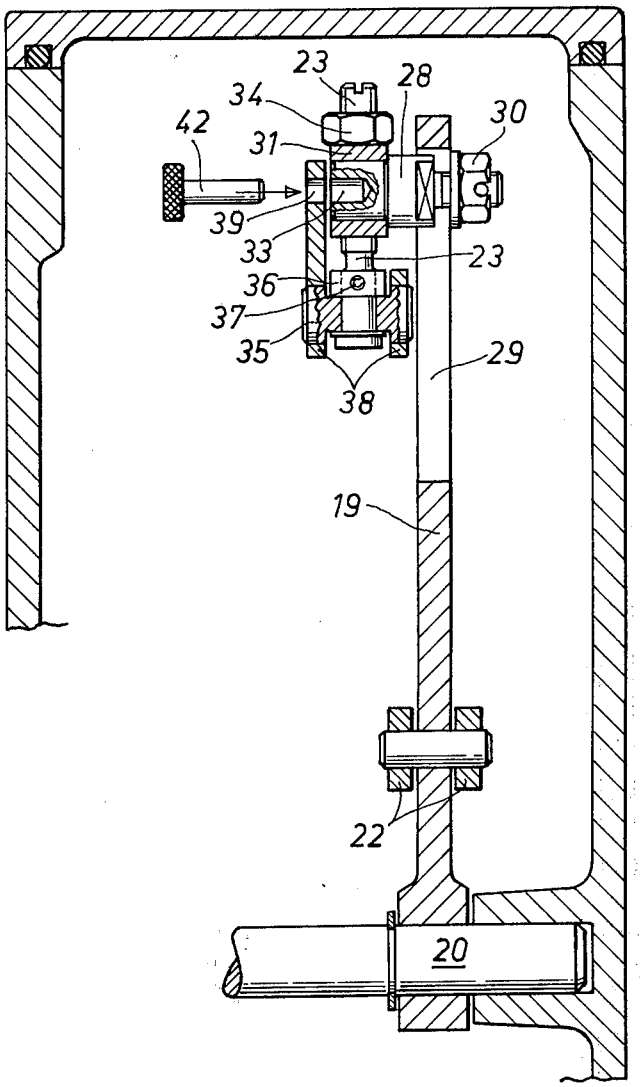
FIG. 3 is a partial cross-sectional view taken along the line III—III of FIG. 2.

As shown most clearly in FIGS. 2 and 3, the connection point 26 is preferably fashioned as a pin member 28 which is accommodated in an elongated hole or slot 29 provided in the transmission lever 19. The pin member 28 is displaceable along the length of the slot 29 to permit an adjustment between the connection point 26 and the pivot point 20 of the transmission lever 19.

The pin member 28 includes a threaded portion extending through a slot 29 on which is received a nut 30 or the like for clamping or fixing the pin 28 at an adjusted position. On a side opposite the threaded portion, the pin member 28 is provided with an abutment surface or shoulder for mounting and positioning a clamping element 31 which is secured to the pin member 28 by way of a set screw 32 or the like.

The arm 23 is fashioned as an adjusting screw and includes an upper threaded portion which is received in a bore of the clamping element 31. Preferably, the bore of the clamping element 31 is provided with suitable internal threading corresponding to the threaded portion of the arm 23 and a counter nut 34 or the like secures the arm 23 in an adjusted position.

The connection point 24 connecting the linkage 21 with the arm 23 is preferably fashioned as a pin 35 which is connected to the arm 23 by way of a setting ring 36 and a clamping pin 37. The connecting linkage 21 is bifurcated at least at one end thereof so as to define two arms 38 provided with aligned bores for receiving and supporting the pin member 35.

The other end of the connecting linkage 21 is secured to a control rod 14 by way of a hinged connection generally designated by the reference numeral 41 which includes a bracket element 43 secured to the end of the control rod 14 by way of a bolt 44 or the like with an elongated or slotted hole 47 being provided in the bracket for accommodating a fastening element such as a bolt 45. The provision of the elongated hole or slot 47 permits adjustment of the connecting linkage 21 with respect to the control rod 14 within predetermined limits.

One arm 38 of the linkage 21 is provided with an additional bore 39 which aligns with a bore 33 provided in the pin member 28. The bores receiving the pin member 35 and the bores 39 and 33 are positioned with respect to one another such that the longitudinal axis of the arm 23 forms a right angle with a line extending between the connection point 26 and the fastening bolt 45.

To adjust the transmission linkage, the distance 25 of the transmission lever 19 theoretically associated with a desired stroke of the control rod 14 of the fuel metering device 15 is set prior to starting the internal combustion engine and the pin member 28 is fixedly secured to the transmission lever 19 by way of the nut 30 at the set position. An adjusting pin 42 is introduced through the bore 39 of the fork 38 into the bore 33 of the pin member 28 whereby the right angle 27 is exactly maintained for the duration of the adjusting work. During this initial setting, the bolt 45 is released and the clamping element 31 is loosely mounted at the pin member 28. After the "zero filling" position has been provided at the governor 11 against the force of the governor spring 17 as well as at the injection pump 15, the bolt 45 and clamping element 31 are tightened and, thereafter, the adjusting pin 42 is removed from the bores 33, 39 and the internal combustion engine is then started.

With the aid of a brake, the normal speed of the internal combustion engine is then set and the thus-produced torque of the internal combustion engine is measured with the power being calculated therefrom.

Due to the dimensional tolerances of the injection pump 15, the governor 11, the housing elements housing the respective elements, and the transmission linkage, the calculated power will not exactly coincide with the required power so that a corresponding fuel filling correction must be effected. This correction can be carried out by releasing the counter nut 34 and rotating the arm 23 in one or the other directions of rotation during the operation of the internal combustion engine without loosing thereby the adjusted "zero filling" position. To aid in carrying out the fine adjustments, preferably the upper end of the arm 23 is provided with a slot for accommodating an adjusting tool. After the fine adjustment is completed, the counter nut 34 is then tightened, whereby the adjustment work is finished.

While we have shown and described only one embodiment in accordance with the present invention, it is understood that the same is not limited thereto, but is susceptible of numerous changes and modifications as known to a person skilled in the art, and we therefor do not wish to be limited to the details shown and described herein, but intend to cover all such changes and modifications as are encompassed by the scope of the appended claims.

We claim:

1. A transmission linkage construction arranged between a universal speed governor and a fuel metering means of an internal combustion engine, the linkage construction selectively positioning a control rod of the fuel metering means in response to predetermined speeds of the internal combustion engine sensed by the governor, the control rod being positionable at a plurality of positions defined between a maximum fuel filling position and a zero fuel filling position, the transmission linkage construction comprising:

a transmission lever means pivotally mounted about a fixed pivot point, means for connecting the governor to said transmission lever means, a first connecting linkage arranged between the control rod and the transmission lever means, means for connecting a first end of the first connecting linkage to the control rod, arm means for connecting a second end of the first connecting linkage to said transmission lever means, means for variably connecting a first portion of said arm means to said transmission lever means, means for connecting a second portion of said arm means to the second end of said first connecting linkage, and means provided at said transmission lever means for permitting an adjustment of the distance between the fixed pivot point of the transmission lever means and the point of connection of said arm means with the transmission lever means, said arm means and said first connecting linkage being arranged with respect to one another such that, in a zero fuel filling position, a longitudinal axis of the arm means subtends an approximately right angle with a line extending through the points of connection of said first connecting linkage with said control rod and with said arm means.

2. A construction according to claim 1, further comprising means for permitting an adjustment of a distance between the variable pivot point of the transmission lever means and the point of connection of the second portion of said arm means to said first connecting linkage.

3. A construction according to claim 2, wherein the universal speed governor is a centrifugal governor which includes a collar means selectively displaceable against a biasing spring means in response to predetermined speeds of the internal combustion engine, and wherein said means for connecting the governor to the transmission lever means includes a second connecting linkage connected to the governor and the transmission lever means such that a displacement of the governor collar results in a corresponding displacement of said second connecting linkage and a pivoting of said transmission lever means.

4. A construction according to claim 3, wherein said means for variably connecting a first portion of said arm means to said transmission lever means includes a pin member, said means for permitting adjustment of the distance between the fixed pivot point of the transmission lever means and the point of connection of said arm means with said transmission lever means includes an elongated slot for receiving a first portion of said pin member, and wherein said means for variably connecting the first portion of said arm means further includes a clamping means for mounting said arm means on a second portion of said pin member, said clamping means being arranged on a holding shoulder provided at the second portion of said pin member.

5. A construction according to claim 4, wherein the second end of said first connecting linkage and the second portion of said pin member are provided with bores therethrough for accommodating an adjusting pin which is mounted in said bores so as to maintain said approximately right angle during assembly of the construction.

6. A construction according to claim 5, wherein said means for permitting an adjustment of the distance between the variable pivot point of the transmission lever means and the point of connection of the second portion of said arm means includes said clamping means having a bore therethrough for receiving the second portion of said arm means, and means for adjustably mounting said arm means at said clamping means.

7. A construction according to claim 6, wherein said adjustable mounting means includes an externally threaded portion provided on the second portion of said arm means, and fastener means having a complimentary threaded portion arranged at the second portion of said arm means.

8. A construction according to claim 7, wherein said clamping means includes an internally threaded portion in said bore for allowing said adjusting pin to be engageable with the externally threaded portion of the second portion of said arm means.

9. A construction according to claim 6, wherein the second end of the first connecting linkage arranged between the control rod and the transmission lever means is bifurcated and includes a pair of aligned bores, said bores for connecting the second portion of said arm means to said first connecting linkage includes a pin means supported in said aligned bores, and means for connecting said pin means to said second portion of said arm means.

10. A construction according to claim 9, wherein said means for connecting said pin means to said second portion of said arm means includes a setting ring and a clamping pin.

11. A construction according to claim 10, wherein said means for connecting said first connecting linkage to the control rod includes a bracket means mounted at the control rod, said bracket means including means for permitting a relative adjustment between the control rod and the first connecting linkage after said first connecting linkage has been secured to said transmission lever means.

12. A construction according to claim 1, wherein the universal speed governor is a centrifugal governor which includes a collar means selectively displaceable against a biasing spring means in response to predetermined speeds of the internal combustion engine, and wherein said means for connecting the governor to the transmission lever means includes a second connecting linkage connected to the governor and the transmission lever means such that a displacement of the governor collar results in a corresponding displacement of said second connecting linkage and a pivoting of said transmission lever means.

13. A construction according to claim 1, wherein said means for variably connecting a first portion of said arm means to said transmission lever means includes a pin member, said means for permitting adjustment of the distance between the fixed pivot point of the transmission lever means and the point of connection of said arm means with said transmission lever means includes an elongated slot for receiving a first portion of said pin member, and wherein said means for variably connecting the first portion of said arm means further includes a clamping means for mounting said arm means on a second portion of said pin member, said clamping means being arranged on a holding shoulder provided at the second portion of said pin member.

14. A construction according to claim 13, wherein the second end of said first connecting linkage and the second portion of said pin member are provided with bores therethrough for accommodating an adjusting pin which is mounted in said bores so as to maintain said approximately right angle during assembly of the construction.

15. A construction according to claim 1, wherein the second end of the first connecting linkage arranged between the control rod and the transmission lever means is bifurcated and includes a pair of aligned bores, said bores for connecting the second portion of said arm means to said first connecting linkage includes a pin means supported in said aligned bores, and means for connecting said pin means to said second portion of said arm means.

16. A construction according to claim 1, wherein said means for connecting said first connecting linkage to the control rod includes a bracket means mounted at the control rod, said bracket means including means for permitting a relative adjustment between the control rod and the first connecting linkage after said first connecting linkage has been secured to said transmission lever means.

17. A construction according to claim 1, wherein said means provided at said transmission lever means for permitting an adjustment of the distance between the fixed pivot point of the transmission lever means and the point of connection of said arm means with the transmission lever means is located at the variable pivot point of the transmission lever means.

* * * * *